US007128098B2

(12) United States Patent
Verclyte

(10) Patent No.: US 7,128,098 B2
(45) Date of Patent: Oct. 31, 2006

(54) TRANSFER GRIPPER FOR A RAPIER WEAVING LOOM

(75) Inventor: Eddy Verclyte, Ieper (BE)

(73) Assignee: Picanol N.V., Ieper (BE)

( * ) Notice: Subject to any disclaimer, the term of this patent is extended or adjusted under 35 U.S.C. 154(b) by 0 days.

(21) Appl. No.: 10/528,409

(22) PCT Filed: Sep. 20, 2002

(86) PCT No.: PCT/EP02/10613

§ 371 (c)(1),
(2), (4) Date: Mar. 18, 2005

(87) PCT Pub. No.: WO2004/033778

PCT Pub. Date: Apr. 22, 2004

(65) Prior Publication Data

US 2005/0284533 A1 Dec. 29, 2005

(51) Int. Cl.
*D03D 47/23* (2006.01)
*D03D 47/25* (2006.01)
*D03D 47/20* (2006.01)

(52) U.S. Cl. ..... 139/448; 139/443; 139/444; 139/446; 139/447

(58) Field of Classification Search ..... 139/443, 139/444, 446, 448, 447
See application file for complete search history.

(56) References Cited

U.S. PATENT DOCUMENTS 4,587,998 A * 5/1986 Egloff et al. ..... 139/448
5,007,463 A 4/1991 Corain et al.
5,113,914 A * 5/1992 Corain ..... 139/448
5,862,837 A * 1/1999 Guenther et al. ..... 139/448
6,092,561 A * 7/2000 Schmid ..... 139/196.2
6,164,342 A * 12/2000 De Jager et al. ..... 139/448
6,179,014 B1 * 1/2001 Shaw ..... 139/448
6,227,259 B1 * 5/2001 Verclyte ..... 139/448
6,305,434 B1 * 10/2001 Speich ..... 139/448
6,453,952 B1 * 9/2002 Verclyte ..... 139/448

FOREIGN PATENT DOCUMENTS

DE 298 11 373 12/1998
GB 1 487 697 10/1977
WO 99/18274 4/1999

OTHER PUBLICATIONS

Answers.com, Springs, Types of Springs, entire document.*

* cited by examiner

*Primary Examiner*—Gary L. Welch
*Assistant Examiner*—Robert Muromoto
(74) *Attorney, Agent, or Firm*—Bacon & Thomas

(57) ABSTRACT

A thread section of a weft thread is held precisely ready for a receiving rapier in a feed rapier on a rapier loom despite the effects of retarding forces. Deflections of the thread section by the head of a receiving gripper are compensated for, whereby the feed rapier is provided with a thread clamp on the side facing the feed device for the weft thread, which releases on tension forces occurring in the thread section and permits a deflection of the thread section.

15 Claims, 5 Drawing Sheets

TRANSFER GRIPPER FOR A RAPIER WEAVING LOOM

A. BACKGROUND OF THE INVENTION

1. Field

The invention relates to a transfer gripper for a rapier weaving loom having yarn clamps for keeping in readiness a piece or length of a weft yarn to be taken over by a receiving gripper and extending between yarn clamps.

2. Related Art

In modern rapier weaving looms, the transfer grippers, located on a rapier band or rapier rod, are moved at very high speeds. They must be braked down from this high speed when they reach the transfer point where a receiving gripper takes over the weft yarn. Because of its inertia, it can happen that the weft yarn moves onward, so that the piece of yarn to be taken over by the receiving gripper moves away from its specified position. It can then happen that the receiving gripper will not grasp the weft yarn, causing a weft fault. The risk that the piece of yarn to be taken over will come loose can also occur, especially with heavy weft yarns, even if a properly functioning yarn brake is provided on the insertion side, since the forces of inertia stretch the weft yarn elastically downstream of the yarn brake.

A piece of yarn to be taken over by a receiving gripper is prevented from coming loose if this piece is held between two yarn clamps (British patent specification GB 14 87 897). In this kind of construction, two identical yarn clamps are provided, which are loaded by the same spring element. The piece of yarn located between the two yarn clamps and meant to be taken over by the receiving gripper will not move out of range of the specified position even upon braking down from high speeds. The receiving gripper has a hooklike head with which it must reach behind the piece of yarn that is held between the two yarn clamps. In the process, the hooklike head deflects the piece of yarn, which then moves backward behind the hook when the hooklike head is moved past that piece of yarn. This deflection, if the weft yarns are not very elastic and/or have only relatively low strength, can cause the piece of yarn to become damaged or destroyed, so that the piece cannot be grasped then, and a weft fault occurs.

B. BRIEF SUMMARY OF THE INVENTION

The object of the invention is to provide a transfer gripper of the type described above in such a way that deflection of the piece of yarn between the two yarn clamps will not cause any damage and/or destruction of that piece.

This object is attained in that a clamp element that is resiliently yieldable in response to tensile force occurring in the length of yarn and to permit deflection of the length of yarn is provided.

The yarn clamps securely hold the weft yarn that they clamp in extended and tensioned condition, even at high forces of deceleration, so that the piece of yarn does not move away from its specified position. The deflection of the piece of yarn caused by the hooklike element of the receiving gripper generates additional tensile forces in that piece; because of these forces, the resiliently yieldable element yields in such a way that excessive stress on the piece of yarn is avoided. Once the receiving gripper has entered far enough into the receiving gripper that the hooklike element engages the piece of yarn from behind, the deflection of the piece of yarn is reversed as the resiliently yieldable element moves back into its basic position. In the process the piece of yarn is tensioned again, so that it securely moves behind the hooklike element and is grasped.

C. DESCRIPTION OF THE DRAWINGS

Further characteristics and advantages of the invention will become apparent from the dependent claims and the ensuing description of exemplary embodiments.

D. DETAILED DESCRIPTION OF PREFERRED EMBODIMENTS OF THE INVENTION

Figure 1:
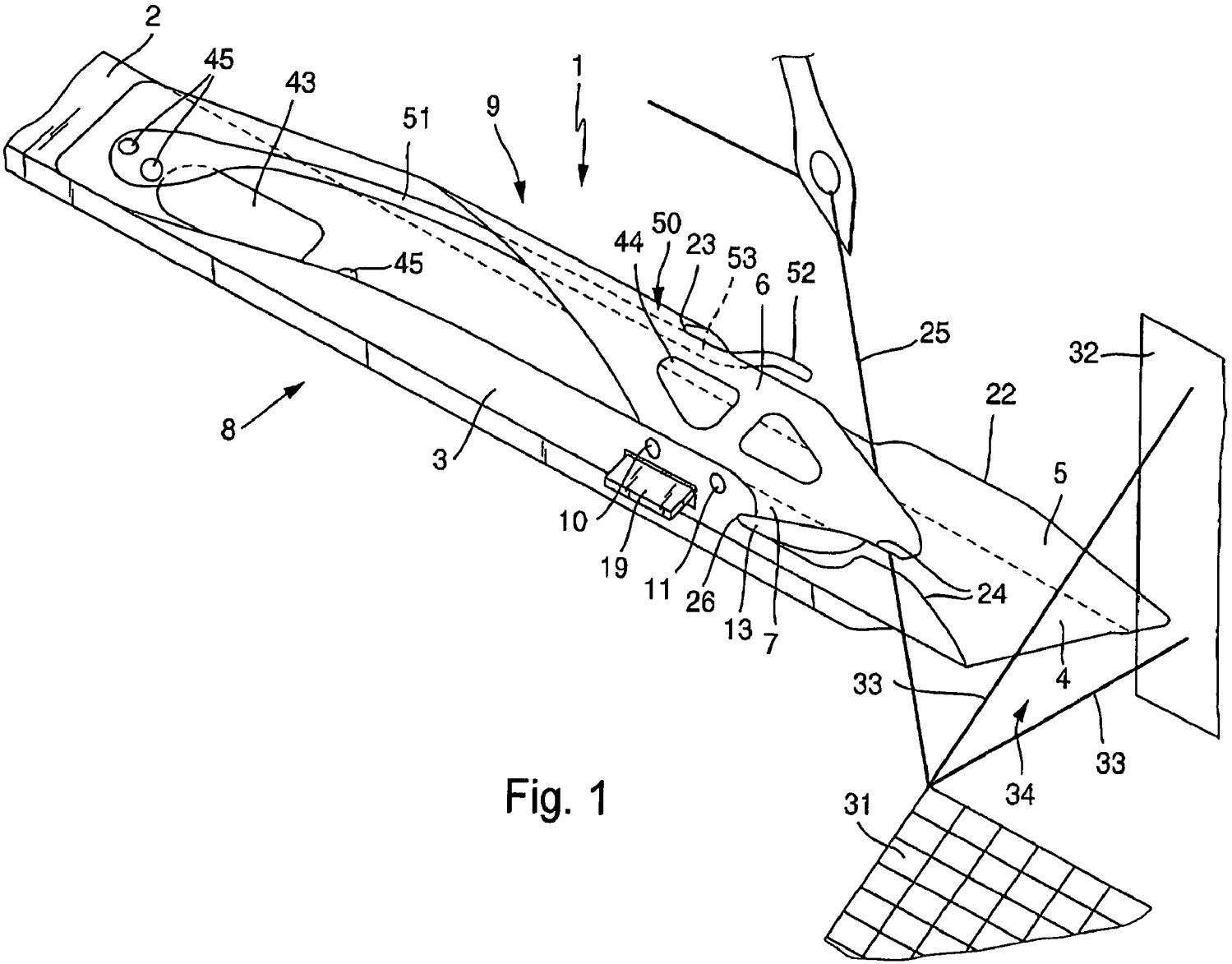
FIG. 1 shows a transfer gripper according to the invention, upon the approach to a weft yarn held in readiness.

The transfer gripper 1 shown in the drawings as an exemplary embodiment corresponds in its basic construction to the transfer gripper described in U.S. Pat. No. 6,227,259, the description of which is hereby incorporated by reference. In the present application, the same reference numerals are used. In addition, the transfer gripper 1 of the invention is equipped with a second, uncontrolled yarn clamp 50, whose function will be explained hereinafter. This additional yarn clamp is formed by a clamp element 51, embodied as a leaf spring, and the inner face of the portion 6 of the transfer gripper 1 that forms the top side of the base body. The spring-elastic clamp element 51 is fastened to the portion 4 that forms the bottom of the base body. In the exemplary embodiment, this fastening is done by means of two screws 45, with which the base body of the transfer gripper 1 is mounted on a rapier band 2. The clamp element 51 designed as a leaf spring extends outwardly and forwardly, past the clamping location of the yarn clamp 50, and includes a guide element 52 that extends forward toward the front end of the transfer gripper 1 along its direction of motion and is bent away to the side and downward. This guide element 52 serves to assure that a weft yarn 25 will securely reach the region of the clamping location 53 of the yarn clamp 50.

Figure 2:
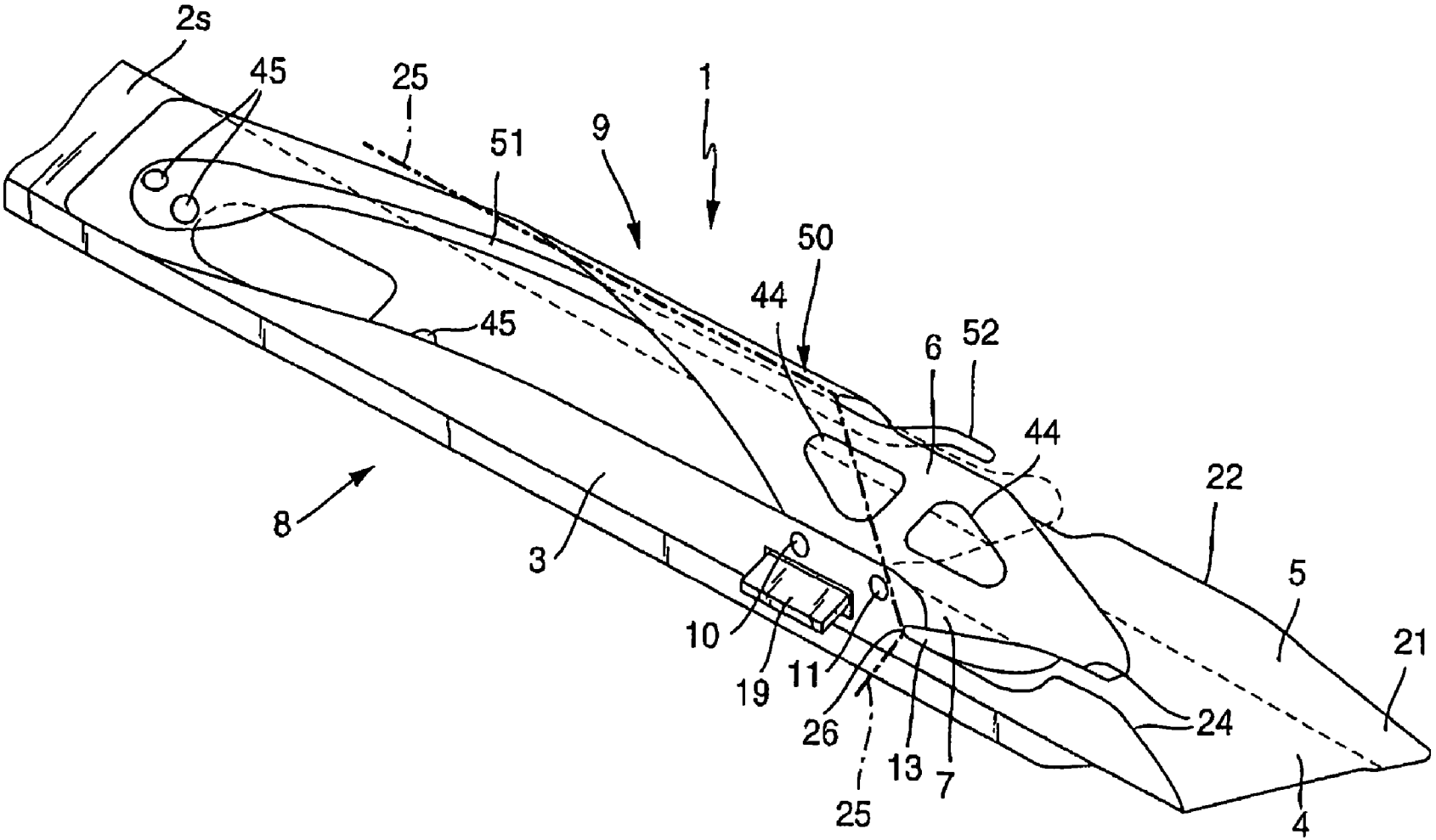
FIG. 2 shows the transfer gripper in its terminal position upon insertion of a weft yarn.
Figure 3:
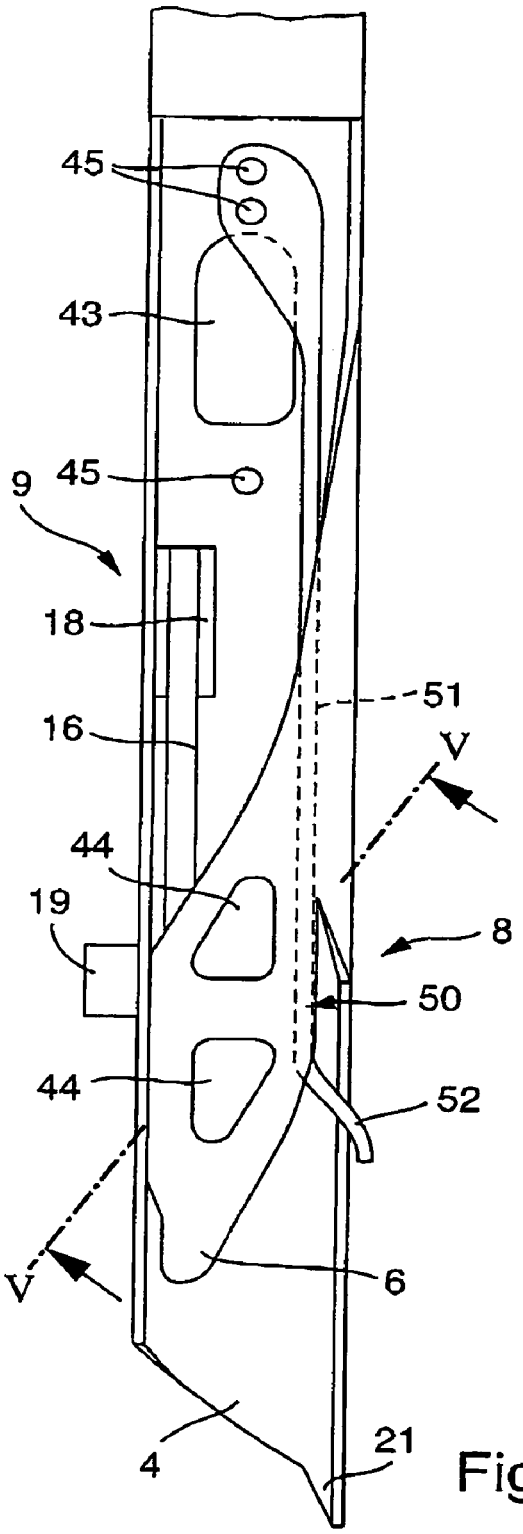
FIG. 3 is a plan view on the transfer gripper on a somewhat different scale.
Figure 4:
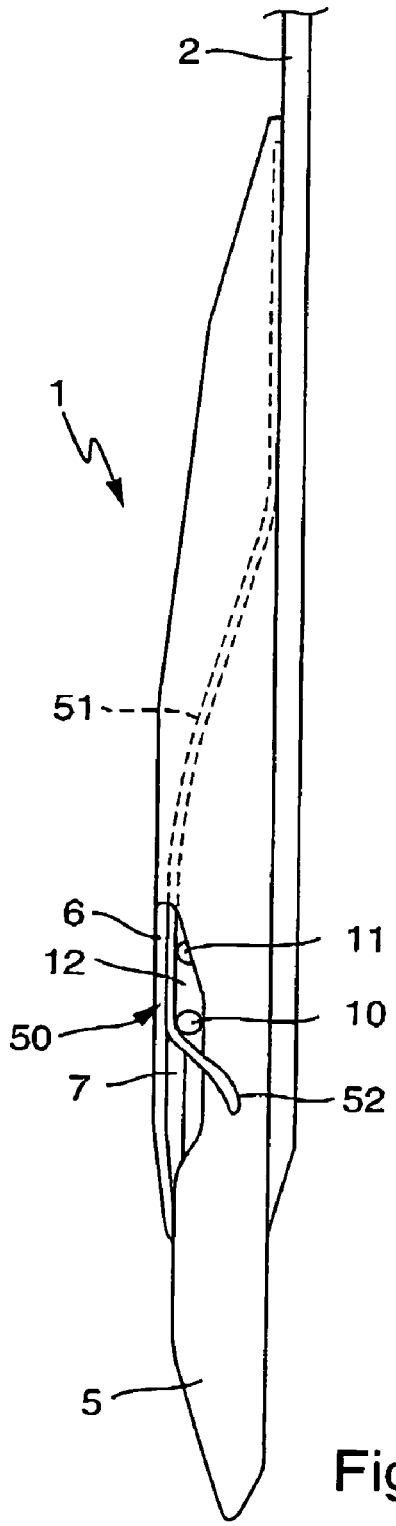
FIG. 4 is a side view of the transfer gripper of FIG. 3.

When the transfer gripper 1 approaches the place where the weft yarn 25 is taken over by a receiving gripper, a very sharp deceleration from high speed takes place down to a standstill. There is then the risk that the weft yarn, because of its inertia, will move away from the region of the stop 23 and move forward in the direction of the front end of the receiving gripper 1, as is shown in FIG. 2. The weft yarn 25 then leaves its predetermined position, so that there is the risk that it will not be grasped by a receiving gripper. This risk is minimized by the yarn clamp 50, which holds the weft yarn 25 in the region of the stop 23 of the guide 22. The clamping force with which the yarn clamp 50 holds the weft yarn 25 is relatively slight, since it needs to prevent only a motion of the weft yarn 25 counter to the forces of inertia that occur upon deceleration. It is also therefore designed to have a low value, since it must be readily possible for the receiving gripper to pull the weft yarn that it grasps out of the yarn clamp 50. For this yarn clamp 50, there is accordingly no need to provide an opening device. The clamping location 53 of the yarn clamp 50 is located somewhat ahead of the stop 23 of the guide 22 in terms of the direction of advancing motion of the transfer gripper. It is thus attained above all that only little dust development is to be expected. Any dust that occurs cannot settle, because of the open structure of the yarn clamp 50.

Figure 5:
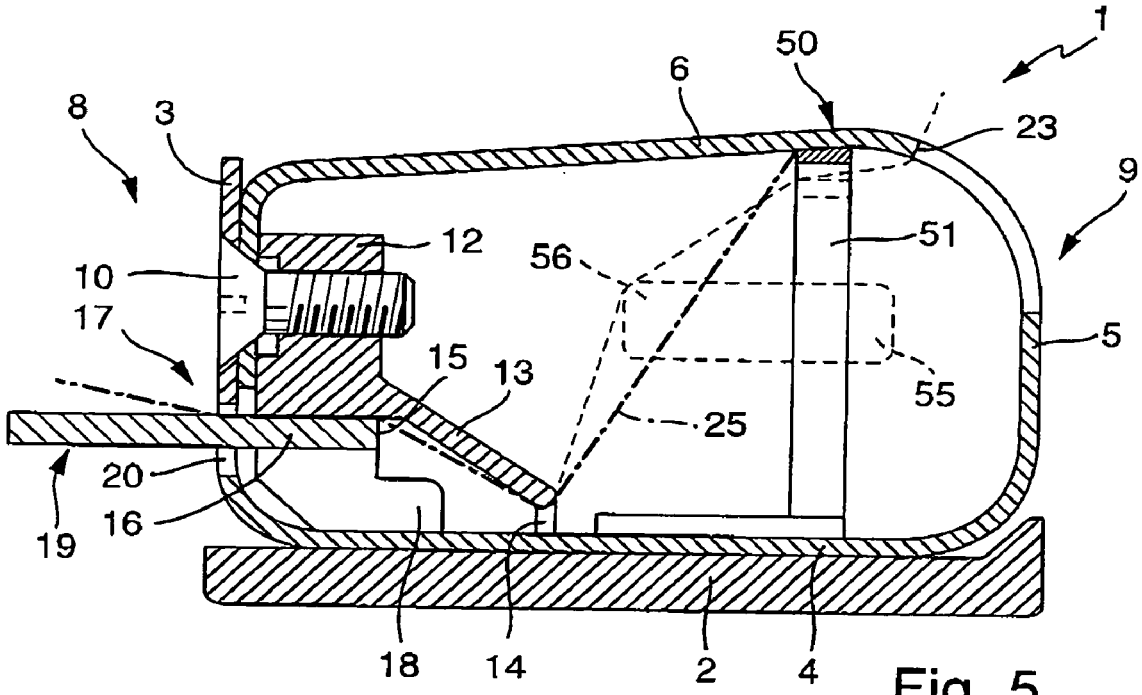
FIG. 5 is a section through the transfer gripper of FIG. 3, taken along the line V—V.

In FIG. 5 dashed lines represent the head of a hooklike receiving gripper 55, which penetrates into the transfer gripper 1. The head 55 has a hooklike attachment 56, which is located facing the piece of the weft yarn 25 that is located between the yarn clamp 15, 16 and the yarn clamp 50. When the head 55 penetrates the transfer gripper 1, the piece of the weft yarn 25 between the yarn clamps 15, 16 and 50 is deflected by the hooklike attachment 56, as is shown in FIG. 5. Once the hooklike attachment 56 has moved past the piece of the weft yarn 25, this piece should resume the taut position shown in FIG. 5, so that it is then grasped and carried along upon the reverse motion of the head 55 of the hooklike receiving gripper.

To permit the deflection of the piece of the weft yarn 25 and also its return motion into the taut position without there being the risk of damage to the weft yarn 25, the yarn clamp 50 is embodied such that a resiliently yielding clamp element 51 of the clamp 50 yields in the opening direction when an additional tensile force is introduced in the piece of yarn located between the two yarn clamps 15, 16 and 50. This yielding is represented by dashed lines in FIG. 5. Since the additional tensile force disappears again once the hooklike attachment 56 has moved past the piece of the weft yarn 25, the resiliently yielding clamp element 51 moves back into the closing position, so that the piece of yarn is tensioned again and securely comes to be located behind the hooklike protrusion 56. In the embodiment of FIG. 5, the opening of the yarn clamp 50 is effected only very briefly, so that the weft yarn 25 does not have the opportunity during this period of time to move out of the yarn clamp 50.

Figure 6:
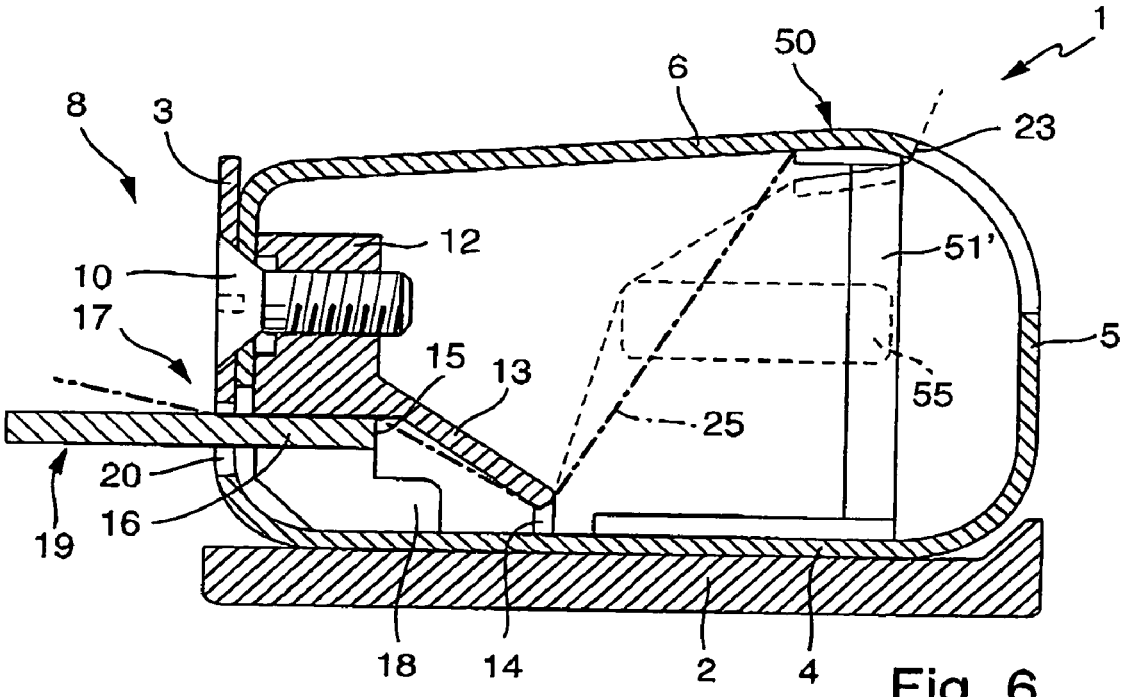
FIG. 6 is a section similar to FIG. 5 through a further embodiment.

For the yarn clamp 50, many different designs are possible. Care must merely be taken to assure that the elements of this yarn clamp 50 do not hinder the penetration of the head 55 of a receiving gripper. In a modified embodiment, the stationary clamping face is a separate component, which is fastened to the base body of the transfer gripper 1. In a further-modified embodiment, the yarn clamp 50 is designed such that it makes the travel distance required to compensate for the deflection of the piece of the weft yarn 25 available without the yarn clamp 50 opening completely. A yarn clamp 50 with this function is shown in FIG. 6. The spring-elastic clamp element 51' has a clamping face that is relatively wide in the direction of motion of the transfer gripper 1, and it is moreover designed such that it can deform elastically, in the form of torsion, about a longitudinal axis extending along the traveling direction of the transfer gripper. As shown in FIG. 6, to compensate for the deflection by the head 55 of the receiving gripper, this clamping face is only tilted, so that the clamping action is not undone entirely.

Figure 7:
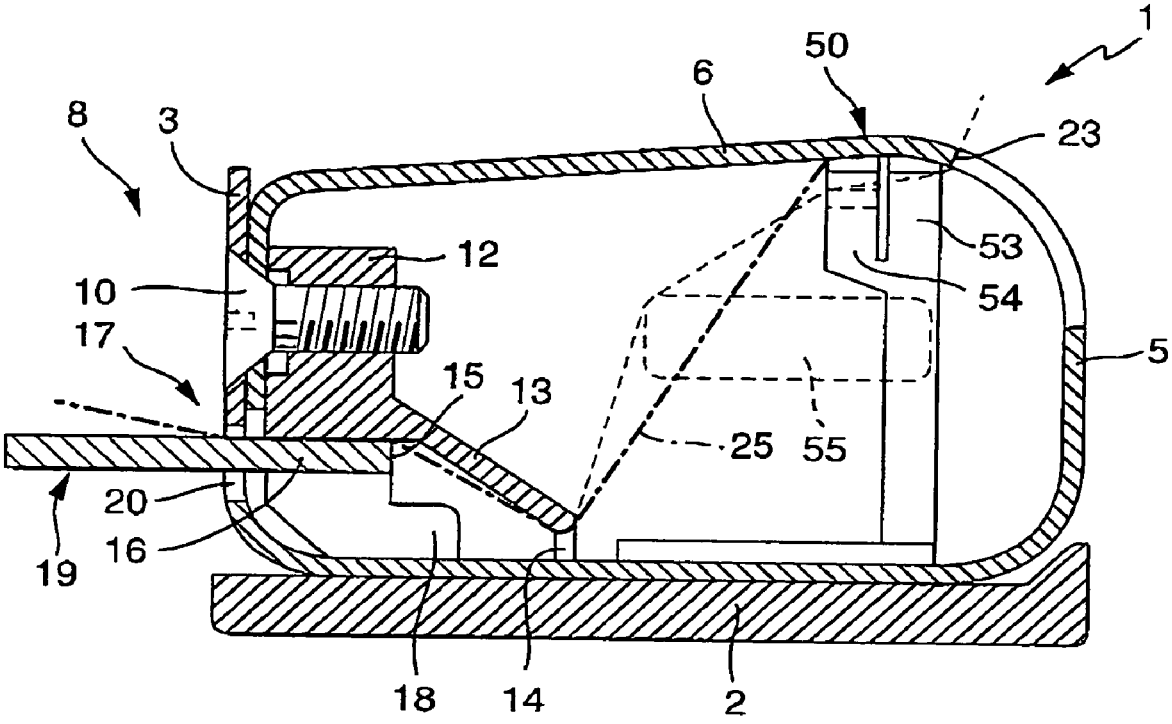
FIG. 7 is a section similar to FIGS. 5 and 6 of a modified embodiment.

In the embodiment of FIG. 7, the yarn clamp 50 has two movable clamp elements 53, 54, which are located side by side. The inner clamp element 54, that is, the clamp element oriented toward the yarn clamp 15, 16 that holds the end of the weft yarn 25, is designed such that when tensile forces occur in the piece of yarn, it yields elastically to the position shown in dashed lines. Conversely, the clamp element 53 is stiffer, so that the part of the yarn clamp 50 formed by this clamp element is not opened. To achieve these different spring stiffnesses, two clamp elements 53, 54, designed and fastened independently of one another, may be provided instead of the one-part element. Also in this embodiment, it may be provided that the clamp elements 53, 54 act not directly on the base body 6 but rather on a clamping piece mounted on the base body 6. In a modified embodiment, it is provided that the elastic element that yields upon tensile forces in the piece of yarn, for instance the element 54, does not clamp the weft yarn 25, but only deflects it. This kind of elastic element is then, in a modified embodiment, located in the vicinity of the yarn clamp 15, 16 or of the deflector 13.

The resilient element itself need not be a spring-elastic element. For instance, a rigid, cranklike element may be provided that is rotatably supported and is retained by a torsion spring. In a modified embodiment, it is then further provided that the clamp element is not held in a spring-elastically yielding way but instead by means of magnetic forces; permanent magnets or electrically triggerable magnets may be employed.

In the exemplary embodiments, it is provided that the yarn clamp 15, 16 associated with the free end of the weft yarn 25 is located in the lower region of the transfer gripper 1, while the second yarn clamp 15 is located in the upper region of the transfer gripper 1. It is understood that this arrangement may also be transposed.

The invention is also not limited to the form of the base body of the transfer gripper 1. In particular, transfer grippers may also be employed which are put together from a plurality of elements.

The invention claimed is:

1. A transfer gripper for a rapier weaving loom, comprising a base body and at least first and second yarn clamps arranged to retain in readiness relative to the base body a length of a waft yarn to be taken up by a receiving gripper, said length of weft yarn during operation of the transfer gripper extending between the yarn clamps in extended and tensioned condition to enable the respective weft yarn to be taken up by a receiving gripper; and further comprising at least one resilient element resiliently yieldable in response to additional tensile force applied to the length of weft yarn to permit deflection of the length of weft yarn between the yarn clamps in response to the additional tensile force while maintaining the length of weft yarn extended in tension between the yarn clamps.

2. The transfer gripper of claim 1, said resilient element cooperating with the second yarn clamp and located rearwardly of the second yarn clamp relative to a leading end of the weft yarn.

3. The transfer gripper of claim 1, said resilient element cooperating with the second yarn clamp.

4. The transfer gripper of claim 3, wherein the resilient element is arranged to constitute a weft yarn damping part of the second yarn clamp.

5. The transfer gripper of claim 1, said base body including first and second side walls, a top side and a bottom; a first yarn guide disposed in the region of said first side wall and the bottom, and a second yarn guide disposed in the region of the second side wall and the top side; said first and second yarn clamps respectively disposed in the vicinity of said first and second yarn guides.

6. The transfer gripper of claim 1, including a fixed clamping face cooperating with said resilient element for engaging and retaining said length of weft yarn.

7. The transfer gripper of claim 6, wherein said resilient element is arranged so as to be movable away from the fixed clamping face in response to a tensile force applied to the length of weft yarn extending between the first and second yarn clamps.

8. The transfer gripper of claim 7, wherein the resilient element is arranged so that it is rotatable about an axis extending along a direction of motion of the transfer gripper in response to an additional tensile force applied to the length of weft yarn extending between the yarn clamps.

9. The transfer gripper of claim 6, said base including an inner face of a top side of the base body, said inner face comprising said fixed clamping face.

10. The transfer gripper of claim 6, said fixed clamping face comprising a clamping piece mounted on the base body.

11. The transfer gripper of claim 1, said resilient element comprising a leaf spring.

12. The transfer gripper of claim 1, said resilient element including a guide element protruding outwardly towards a front end of the base body, and below the region of a clamping location of the second yarn clamp.

13. The transfer gripper of claim 1, wherein a clamping location of the second yarn clamp is disposed rearwardly relative to the first yarn clamp and relative to a leading end of the weft yarn.

14. The transfer gripper of claim 1, said base body including a side wall and a yarn guide defined at least in part by the side wall, said side wall further defining a yarn stop, wherein the clamping location of the second yarn clamp is located forward of the yarn stop relative to an advancing direction of motion of the transfer gripper in operation.

15. The transfer gripper of claim 1, said at least one resilient element comprising a pair of resilient elements disposed lengthwise along the length of weft yarn, said pair of resilient elements having different resilient yielding strengths for responding differently to additional tensile forces applied to the length of weft yarn, and wherein the resilient element located closer to the first yarn clamp has a lower yielding strength than the other resilient element.

* * * * *